United States Patent [19]

Grave

[11] Patent Number: 4,488,330

[45] Date of Patent: Dec. 18, 1984

[54] RUG AND UPHOLSTERY CLEANING APPARATUS

[76] Inventor: Dale L. Grave, 125 Queensland La. North, Plymouth, Minn. 55447

[21] Appl. No.: 440,950

[22] Filed: Nov. 12, 1982

[51] Int. Cl.[3] ..... A47L 11/34

[52] U.S. Cl. ..... 15/322

[58] Field of Search ..... 15/321, 322

[56] References Cited

U.S. PATENT DOCUMENTS

| | | | |
|---|---|---|---|
| 742,880 | 11/1903 | Lotz . | |
| 930,628 | 8/1909 | Squier . | |
| 2,292,435 | 8/1942 | Crites | 8/25 |
| 3,262,146 | 7/1966 | Hays | 15/321 |
| 3,654,662 | 4/1972 | Bates | 15/322 |
| 3,663,984 | 5/1972 | Anthony et al. | 15/321 |
| 3,747,155 | 7/1973 | Koellisch | 15/321 X |
| 3,775,053 | 11/1973 | Wisdom | 15/322 X |
| 4,153,968 | 5/1979 | Perkins | 15/321 |
| 4,194,262 | 3/1980 | Finley et al. | 15/321 X |
| 4,308,636 | 1/1982 | Davis | 15/321 |

FOREIGN PATENT DOCUMENTS 449826 10/1912 France .

*Primary Examiner*—Chris K. Moore

*Attorney, Agent, or Firm*—Leo Gregory

[57] ABSTRACT

A rug and upholstery cleaning apparatus comprising a nozzle embodying a pair of chambers separated by a baffle elevated to provide a passage therebelow, one chamber comprising a suction chamber and the other a cleaning chamber having a jet directing a stream of cleaning fluid to the area of said passage and angled to penetrate and sweep through the pile of the material being cleaned to the depth of the soil therein, the combined action of suction chamber and pressure of the stream of cleaning fluid causing the pile to tend to become erect and aligned, and the suction in a simultaneous action with the injection of cleaning fluid causes the cleaning fluid to have a sweeping action through the pile and the suction withdraws the cleaning fluid with the soil therein to the extent that whereby what is substantially dampness remains in the pile.

7 Claims, 9 Drawing Figures

56
38
100
130
111
108a
108
110
101
109
112
114
107
106
115
125
121
57
59
102
132
107a
108b
120
122
116
117
118
119
9

RUG AND UPHOLSTERY CLEANING APPARATUS

BACKGROUND OF THE INVENTION

1. Field of the Invention.

This invention relates to a nozzle structure of a rug or upholstery cleaning apparatus in which the injection and withdrawal of cleaning fluid in a sweeping action through the pile of the rug or upholstery being cleaned is a simultaneous and continuous action.

2. Description of the Prior Art.

Rug and upholstery cleaning devices in general use are arranged and constructed to direct a stream of cleaning fluid directly onto the base of the material to be cleaned with the driving force of the cleaning fluid being utilized to loosen the soil. The result of directing cleaning fluid onto the base of the surface cleaned tends to drive dirt and/or soil into the structure of the base and also results in a puddling or collection of cleaning fluid thereon whereupon the suction used is directed to withdraw the cleaning fluid after it has become puddled and subsequent to the cleaning effort of the surface.

Prior art practice as described in Hayes U.S. Pat. No. 3,262,146 shows a two chamber nozzle structure with which a high pressure stream solvent solution is applied from one chamber and a vacuum in an adjacent chamber condenses and collects the cleaning vapor. Shown are downwardly opening chambers terminating in a common plane with lower edges notched for entry of air. The spray head is angled downwardly having the emerging stream impact against a wall surface of the spray head and becoming deflected down directly into the pile or nap of the material being cleaned. The whole impact is in a substantially vertical direction resulting in beating down into the warp or base of the material being cleaned with the full impact of the cleaning fluid and the soil and dirt which is present becomes impacted into the warp or base. The stream solvent is condensed upon contact with the material and condensated will tend to puddle or settle upon the base of the material. Here the vacuum attempts to withdraw the fluid after it has become settled or puddled upon the material being cleaned.

Squier in U.S. Pat. No. 930,628 embodies a brush for cleaning, the brush being manipulated in a spinning scrubbing action.

Thomsen in his French Pat. No. 449,826 embodies the use of an oscillating brush. In Crites in U.S. Pat. No. 2,292,435, a rotary brush is used.

Grave, the applicant herein, in his U.S. Pat. No. 3,431,582, discloses a cleaning head over which the present invention represents substantial improvement and in which the cleaning fluid under high pressure is discharged directly down into the base of the material to be cleaned prior to being withdrawn by suction.

Lotz in U.S. Pat. No. 742,880 discloses a cleaning head or nozzle causing the soil picked up to be withdrawn through a narrow slit suction inlet with an adjacent funnel opening head which sprays water upon the surface being cleaned.

Other commonly used cleaning devices utilize a rotating or spinning pad such as a felt pad which is impregnated with or accompanied by cleaning fluid as it spins over the surface and in effect beating the cleaning fluid into the material and in an abrasive action using its pressure and spinning effect to disperse the cleaning fluid through the surface cleaned.

SUMMARY OF THE INVENTION

This invention relates in particular to a nozzle structure used with a rug or upholstery cleaning apparatus, the periphery of the nozzle being surface engaging and embodying a suction and a cleaning chamber and suction together with the application of cleaning fluid under pressure causes the pile of a rug to become raised and aligned in the applied direction of the cleaning fluid and the surface of upholstery material to become raised and the stream of cleaning fluid is directed to sweep through the raised pile or upholstery material and is withdrawn therefrom by suction in a simultaneous and continuous action whereby substantially the only residue of the cleaning fluid and soil picked up thereby is the dampness of the material cleaned.

It is an object of this invention to provide a nozzle structure particularly designed to sweep a cleaning fluid through the pile of a rug or surface portion of an upholstery material whereby the soil is picked up and maintained in suspension within the body of cleaning fluid and that simultaneous with the cleaning action and in effect as a continuation thereof, the cleaning fluid with the soil therein is withdrawn and discharged.

It is another object of this invention to provide a nozzle structure particularly arranged to direct a stream of cleaning fluid to clean a surface to the extent that there is soil penetration and to avoid beating the soil into the base of the material cleaned.

It is a further object of this invention to provide a nozzle structure in connection with a cleaning apparatus embodying a cleaning and a cooperating extraction chamber in which the application of cleaning fluid is directed to be at a shallow angle to the surface to be cleaned and its extraction laden with soil is a continuing simultaneous action.

More specifically, it is an object of this invention to provide a nozzle structure for a rug cleaning apparatus in which a jet directs a stream of cleaning fluid at such an angle as to cause the pile of the surface cleaned to tend to become erect and aligned and to pass through the pile at a depth approximating the depth of the penetration of soil therein, the nozzle including a raised baffle providing an area of reduced pressure and a suction hose within said area whereby in an action simultaneous with the action of the cleaning fluid sweeping through the pile assisted by an air stream through inlet ports, the suction in a venturi like action withdraws the fluid and the soil therein from the pile, thus avoiding the deposit of soil and the collection of fluid as in puddles on the surface cleaned. Upholstery material is cleaned in a like manner.

These and other objects and advantages of the invention will be set forth in the following description made in connection with the accompanying drawings in which like reference characters refer to similar parts throughout the several views.

BRIEF DESCRIPTION OF THE DRAWINGS

FIGS. 6–8 are respectively broken views in top plan, side elevation and in bottom plan with a portion broken out, and FIG. 9 is a view on an enlarged scale in vertical section taken on line 9—9 of FIG. 6 as indicated.

DESCRIPTION OF A PREFERRED EMBODIMENT

Figure 3:
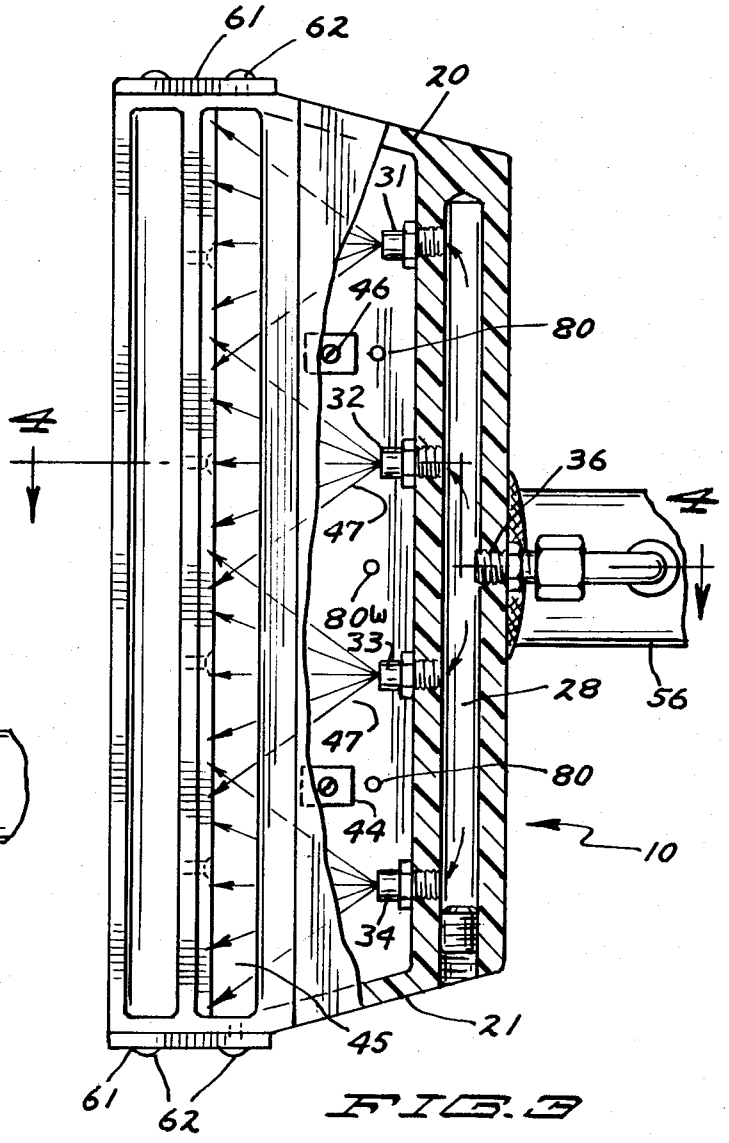
FIG. 3 is a view similar to FIG. 2 on an enlarged scale with portions thereof broken away.
Figure 2:
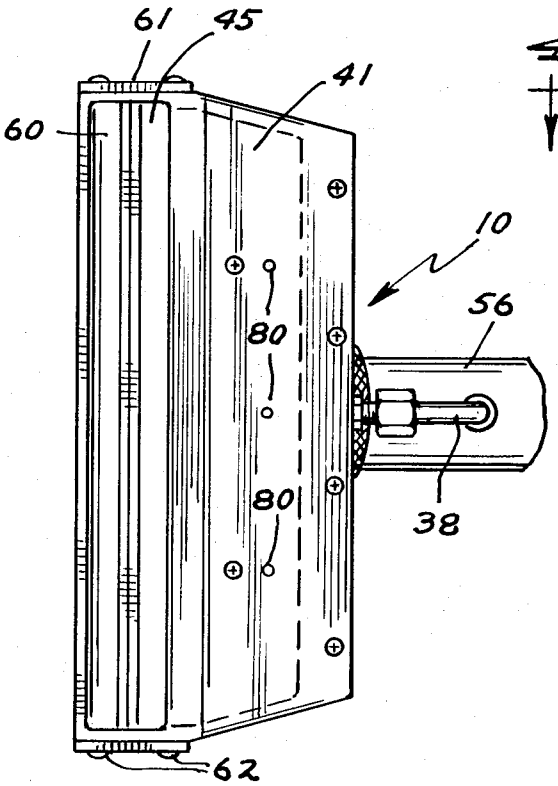
FIG. 2 is a bottom plan view partially in perspective.
Figure 1:
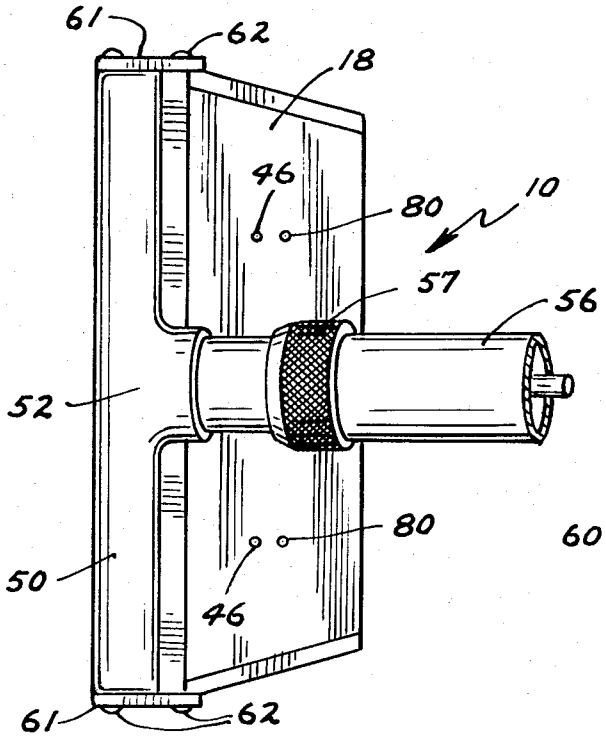
FIG. 1 is a top plan view partially in perspective.

Referring to the drawings, the nozzle or nozzle structure comprising the subject matter of the invention herein is indicated generally at 10. The cleaning apparatus with which the nozzle is intended for use is referred to incidentally, it is not shown and forms no part of the present invention.

Said nozzle preferably is made up for the most part of suitable plastic molded components.

Said nozzle comprises two basic functionally related portions or heads—the cleaning head 14 and the suction and discharge or withdrawal head 16.

Referring first to said cleaning head, the same comprises an overhead wall or plate 18 which is substantially rectangular in plan. It will be noted in FIG. 4, said plate member 18 in operating position is inclined downwardly forwardly on the order of 30° and has a depending front end wall 19 which in operating position is substantially at right angles to the horizontal. This front end wall will be further described. Said top plate has depending side walls 20 and 21.

The rearward portion of said plate 18 is a downwardly projecting portion 23 of sufficient cross sectional dimension to form a manifold having a substantially full width cylindrical chamber 28 therein. Tapped into the front wall 29 of said chamber and spaced therealong in communication with said chamber are jet fittings or jets 31, 32, 33 and 34. Entering said chamber 28 centrally rearwardly thereof is an inlet fitting 36 forming a port, the same being tapped into the rear wall 25. Leading to and being suitably connected with said inlet fitting 36 is a supply line 38 which will run to a source of a suitable cleaning fluid.

Underlying said plate member 18 in spaced relation and secured to the bottom wall 30 of said manifold by screws 42 and extending between the side walls 20 and 21 is a bottom wall 41. Said bottom wall is further secured by a pair of transversely spaced posts 44 extending between it and said top plate 18, the same being secured by screws 46 extending therethrough from said bottom wall to said top plate.

Referring to the jets 31–34, the slotted outlets **31*a*–34*a* thereof are designed to eject a wide flared or fan shaped spray or stream 47. It will be noted in FIG. 5 that the outlets 32*a* and 33*d*** preferably are angled axially whereby the adjacent portions of the sprays will overlap in a vertically spaced relationship.

The bottom wall 41 terminates at a point spaced from the end wall 19 forming an opening 45 shown here to be an elongated slot therebetween through which the streams of cleaning fluid 47 will be directed to the underlying space thereof as will be further described.

Suitably mounted overlying the cleaning head 14 is the suction or withdrawal head 16.

Said withdrawal head comprises a forward or front end molded manifold 50 extending the width of said end wall 19 and comprising spaced walls **50*a* and 51*a* with the wall 51*a* being secured to the end wall 19 as by screws 62. Said end wall 51*a* is coterminus with said end wall 19 and the end wall 50*a* is shown extending downwardly of the tapered end portion 41*a*. Formed between the lower ends of said walls 50*a* and 51*a* is a suction opening 60 shown being slotted. In operating position the end wall 50*a* and the bottom wall portion 41*a*** will rest flush upon a surface to be cleaned.

Said manifold 50 is formed to have a central upward tubular shank 52 which is angled rearwardly with a curved radius to overlie said plate member 18 and having an extended tubular portion 53 terminating in an outlet end portion **53*a* to which is connected a suction line 56 fitting thereover with an externally threaded portion 56*a* thereof and a compression closure or locking ring 57 is threaded thereon having therebetween an O-ring seal 59**.

Within said manifold 50 is a suction chamber 67 and within said cleaning head 14 is a chamber 65.

As described, the bottom wall 41 has a forward tapered end portion **41*a*. The walls 51*a* and 19 are raised above the planar level of the bottom wall portion 41*a* whereby in effect the walls 51*a* and 19 taken together form a raised baffle separating the cleaning chamber 65 from the suction chamber 67 providing a passage 66** thereunder.

Figures 4, 5:
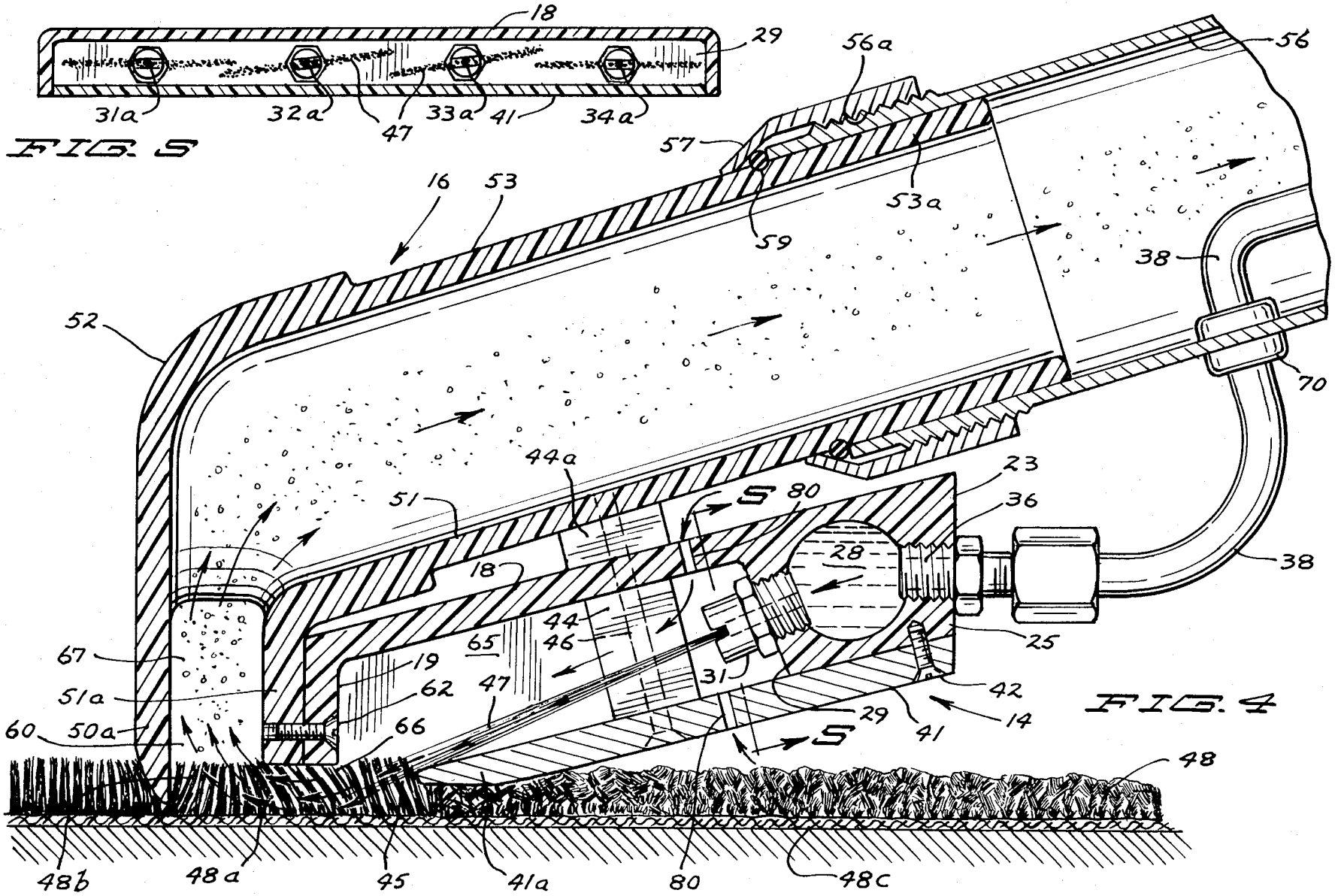
FIG. 4 is a view on a magnified scale in vertical transverse section taken on line 4—4 of FIG. 3 as indicated.
FIG. 5 is a view in vertical transverse section taken on line 5—5 of FIG. 4 as indicated.
Figures 5, 7, 8, 9:
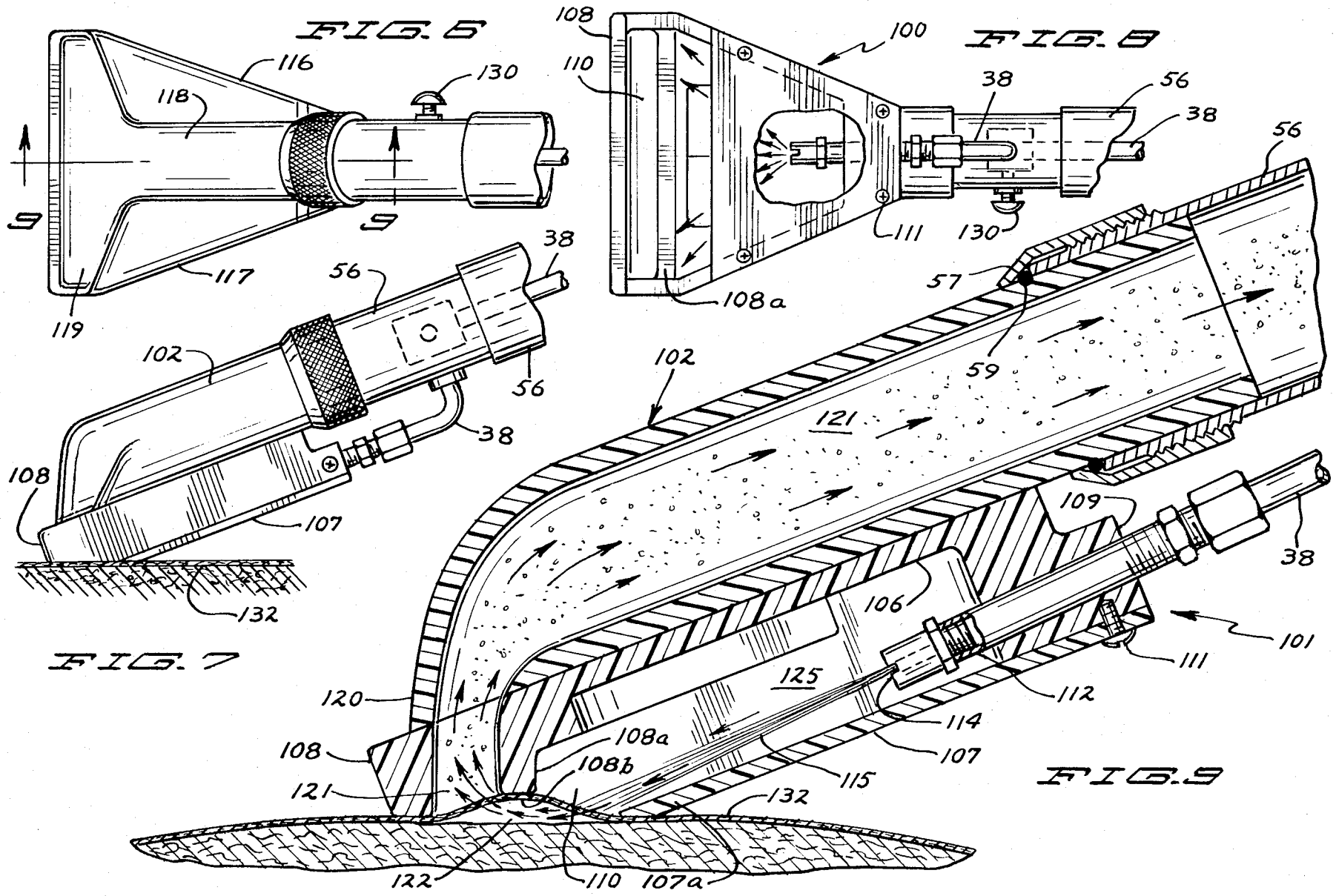

For purpose of illustration, a rug 48 is shown in FIG. 4 with the pile thereof indicated as being in a usual crushed condition. At **48*b* the pile is shown raised by action of the suction chamber 67 and at 48*a* the pile is shown aligned as indicated and swept through by the shallow angled directed stream of cleaning fluid 47. The warp or base of said rug is indicated at 48*c***.

For purpose of convenience the supply line 38 is run through the suction line 56 and extends outwardly at 70 for connection to the inlet fitting 36.

Spaced across the upper wall 18 and the lower wall 41 are a plurality of air holes or ports 80.

It will be noted that a spacer **44*a* forms an extension of the post 44 between the wall 18 and the bottom wall 51 of the suction head 16. The screw 46 extends through said spacer and extends into said bottom wall 51** for securing said cleaning and suction heads together.

OPERATION

The particular arrangement and operation of the nozzle structure represents significant improvement over prior art cleaning nozzles as described in the Background and Summary of the Invention herein.

The nozzle is held at an operating angle of some 30° to the horizontal which positions the bottom wall portion **41*a* to be flush upon the surface to be cleaned confining the cleaning action to be substantially within the area defined by slots 45–60** of the nozzle structure.

The baffle member 19 and the adjacent end wall **51*a* being spaced upwardly provide the passage 66 for direct communication between the cleaning chamber 65 and the suction chamber 67. The jets 31–34** are particularly positioned to eject streams of cleaning fluid at such a shallow angle as to have a sweeping action through the raised pile.

The suction and the cleaning steps are in a complementary simultaneous operation and serve to align the pile in an upward position as shown at **48*a***. The suction tends to raise the pile of the material cleaned. The angle of the cleaning fluid is such that the cleaning fluid enters the raised pile in a sweeping action which tends to both align and penetrate the pile to the depth that soil is generally present and lodged therein and avoids direct impact upon the base or warp of the rug and does not impact or drive the soil into said base of the rug.

The suction and cleaning steps in a continuous action with a reduced pressure in the suction chamber causes a venturi effect to be present with regard to the cleaning fluid being drawn into the suction chamber through the raised pile. The cleaning fluid and soil therein is thus accelerated into the suction chamber. It is the combination of a high pressure thrust of cleaning fluid (150 psi–2,000 psi, as desired) of cleaning fluid sweeping through the pile and the pulling effect of the suction which effectively withdraws the cleaning fluid from the pile lifting out with it the loosened soil within the stream of cleaning fluid. Avoided here is the opportunity for the cleaning fluid to settle or puddle and also avoided is the opportunity for the soil within the stream of cleaning fluid to settle down or become deposited upon the base of the material cleaned. The result is what is substantially a complete removal of liquid and soil with a residue of dampness in the pile.

The jet streams of cleaning fluid upon engagement with the pile together with the simultaneous suction upon the pile tends to align the pile in the direction in which the cleaning fluid in effect is swept through the pile. The basic cleaning movement of the nozzle may be in the direction of the operator although it may be in a forward backward motion towards and away from the operator with the final motion being in the direction toward the operator, the effect of the suction is to cause the pile to be in a raised upright position upon completion of the cleaning action. There is ample flow of air entering through the holes 80 to support the movement of the cleaning fluid. Air may also be drawn in at or about the passage 66 by the cleaning action.

The cleaning fluid supply line and the suction line will be operated by a hand valve control not here shown and which is a conventional flow control type of valve.

The significant aspect of the method and operation of the structure herein is the dual simultaneous function of a high pressure spray of cleaning fluid entering into and being at the same time sucked through the pile which action keeps the cleaning fluid in constant motion with the result of leaving as a residue substantially only a dampness in the pile as above indicated.

A higher degree of pressure than otherwise may be used in connection with the structure herein in directing the stream of cleaning fluid through the pile due to avoiding direct impact upon the base of the material.

It will be noted in FIG. 5, that the jet streams from the jets 32 and 33 are here shown preferably angled axially sufficiently to avoid the inter-engagement of the overlapping portions of the streams from the jets 31 and 34. This is a matter of preference.

The nozzle as disclosed and described herein has been very successful in actual practice in achieving excellent cleaning results with carpeting and with upholstery materials.

MODIFICATION

Referring to FIGS. 6–9, a modification is shown of the nozzle structure above described, this modification representing a nozzle reduced in size to be more particularly adapted to clean upholstery material but is also desirable for use in cleaning rugs in restricted areas or as for spot cleaning purposes. The portions hereof above described are indicated by like reference numbers.

The nozzle structure is indicated generally by the reference numeral 100 and comprises a cleaning head 101 and a suction head 102.

The cleaning head is described as a manifold comprising a housing being substantially rectangular in vertical cross section and flared outwardly in plan having a top wall 106, a bottom wall 107, end walls 108 and 109 and side walls 116 and 117. Said bottom wall 107 is secured by screws 111 to said end wall 109 and side walls 116 and 117. The end wall 108 is spaced from the adjacent end **107*a* of the bottom wall 107 to form the slot opening 110 therebetween. Disposed through the end wall 109 is a jet 112 connected to said supply line 38. Said jet has an aperture 114 which ejects a fan shaped spray 115 of cleaning fluid at a shallow angle to an underlying surface at the area of said slot 110. Within said cleaning head is a chamber 125**.

Overlying said cleaning head 101 is said suction head 102 having a cylindrical body portion 118 terminating in a flared fan shaped end portion 119 having a suction passage 121 therethrough and having a terminal manifold portion 120 curved downwardly extending said passage 121 through the end wall 108. The inner portion **108*a* of said end wall 108 serves as a baffle which separates the suction passage 121 from the chamber 125 of the cleaning head and it is noted that said baffle has a raised bottom 108*b* providing a passage 122 for communication thereunder between the chamber 125 and the passage 121**.

As previously described, the supply line passes through the suction line 56 for purpose of convenience. An off-on valve 130 has the supply line 38 pass therethrough for manual control thereof.

The operation of this nozzle 100 is substantially as described above. Upholstery fabric indicated by the reference numeral 132 is fairly thin and porous material. It is to be noted at the area of the passage 122 that the fabric 132 is raised by the suction of the passage 121 and the stream of cleaning fluid 115 is directed to this area to penetrate and simultaneously be sucked through said raised fabric. With the suction downstream of the stream of cleaning fluid, a venturi effect is present which serves to accelerate the passage of the cleaning fluid through the upholstery material.

Thus the cleaning fluid and the soil loosened thereby is in continuous motion in being drawn through the fabric whereby substantially the only residue is a dampness of the fabric. There appears to be no noticeable deposit or settling of cleaning fluid upon, within or under the outer layer of fabric as is the case where the action of suction is subsequent to and following after the completion of each cleaning stroke wherein puddling, settling and/or deposit of cleaning fluid is present. The nozzle is moved by the operator in a motion away from and towards himself. The suction and cleaning action being simultaneous causes the fabric to be in a raised condition as indicated at 122 for the cleaning effort as described.

The structure and operation of the nozzle as described has resulted in practice as having a very effective cleaning effort leaving a surface which has as a residue substantially only dampness and leaving no saturated surfaces as in the case of prior art devices.

It will of course be understood that various changes may be made in the form, details, arrangement and proportions of the apparatus and in the steps and sequence of steps of the method without departing from the scope of applicant's invention which, generally stated, consists in an apparatus and method capable of carrying out the objects above set forth, such as disclosed and defined in the appended claims.

What is claimed is:

1. In connection with a rug and upholstery material cleaning apparatus, a nozzle structure comprising a housing having a peripheral portion overlying a surface portion to be cleaned of said material, a cleaning chamber and a suction chamber within said housing, means separating said chambers positioned to provide communication therebetween at said surface portion to be cleaned, outlet jets carried in said cleaning chamber ejecting cleaning fluid at such an angle as to pass through said material at said surface portion to be cleaned, said cleaning fluid being directed to sweep through and align said surface portion, air ports into said cleaning chamber, the suction of said suction chamber simultaneous with the ejection of said cleaning fluid and incoming stream of air from said air ports raising said surface portion to be cleaned and withdrawing said cleaning fluid from and drawing said air stream through said raised surface portion in a continuous cleaning action whereby said cleaning fluid and said air stress are under constant movement in being withdrawn and discharged by said suction leaving substantially only dampness in said surface portion as a residue.

2. The structure of claim 1, wherein said cleaning chamber includes a manifold, said jets being mounted onto said manifold in spaced relation, an inlet into said manifold, and a supply line to said inlet from a supply of cleaning fluid.

3. The structure of claim 1, wherein said peripheral portion is rectangular in plan defining therein a pair of elongated slots.

4. The structure of claim 1, wherein said peripheral portion is rectangular in plan defining therein a pair of slots, and said separating means comprises a wall having a raised bottom for a passage between said cleaning and said suction chambers.

5. In connection with rug cleaning apparatus, a nozzle structure comprising a housing having a peripheral portion engaging a surface portion of the pile of said rug to be cleaned, a cleaning chamber and a suction chamber within said housing, a wall separating said chambers, a raised bottom of said wall providing passage thereunder for communication between said chambers, the suction of said suction chamber drawing upon said pile at said first mentioned surface portion of said pile raising the same to upright position, jets carried in said chamber ejecting cleaning fluid, means connecting said jets to a supply of cleaning fluid, air ports allowing air flow into said cleaning chamber, a stream of air flow assisted cleaning fluid directed to said surface portion of said pile by said jets and engaging and aligning said pile in sweeping therethrough, said suction of said suction chamber withdrawing said cleaning fluid and the soil therein from said surface portion of said pile simultaneously with the movement of said air and cleaning fluid sweeping through said pile whereby substantially the only residue of said cleaning fluid is a dampness of said pile.

6. The structure of claim 5, wherein said angle of said cleaning fluid being such as to direct the passage of said cleaning fluid through said pile and over the underlying base portion of said rug.

7. In connection with an upholstery material cleaning apparatus, a nozzle structure comprising a housing having a peripheral portion engaging a surface portion of material to be cleaned, a cleaning chamber and a suction chamber within said housing, means separating said chambers, providing between said chambers a passage passing over said surface portion of said material, the suction of said suction chamber drawing upon and raising said surface portion of said material, air inlet ports into said cleaning chamber, a jet carried in said cleaning chamber, means connecting said jet to a supply of cleaning fluid, a stream of cleaning fluid ejected by said jet combined with air through said ports being particularly directed at such a shallow angle as to sweep through said raised portion of said material, said suction simultaneous with the sweeping action of said air and cleaning fluid causes a continuous movement of said cleaning fluid in withdrawing the same and the soil therein from said material, whereby substantially the only residue is the dampness of said material.

* * * * *